US005967262A

United States Patent [19]

Krause

[11] Patent Number: 5,967,262

[45] Date of Patent: Oct. 19, 1999

[54] PLATFORM UNIT

[75] Inventor: Günther Krause, Alsfeld, Germany

[73] Assignee: Krausse-Werk GmbH & Co. KG, Alsfeld-Altenburg, Germany

[21] Appl. No.: 08/765,831

[22] PCT Filed: May 24, 1995

[86] PCT No.: PCT/EP95/01970

§ 371 Date: Dec. 30, 1996

§ 102(e) Date: Dec. 30, 1996

[87] PCT Pub. No.: WO96/01350

PCT Pub. Date: Jan. 18, 1996

[30] Foreign Application Priority Data

Jul. 1, 1994 [DE] Germany ..... 94 10 468

[51] Int. Cl.[6] ..... E04G 1/15

[52] U.S. Cl. ..... 182/222; 182/119

[58] Field of Search ..... 182/222, 119

[56] References Cited

U.S. PATENT DOCUMENTS 4,331,218 5/1982 Layher ..... 182/119

FOREIGN PATENT DOCUMENTS 0276489 12/1987 European Pat. Off. .

332061 9/1989 European Pat. Off. ..... 182/222

0 451 616 10/1991 European Pat. Off. .

2582702 12/1986 France ..... 182/222

8502756 2/1985 Germany .

586335 2/1977 Switzerland ..... 182/222

*Primary Examiner*—Alvin C. Chin-Shue

*Attorney, Agent, or Firm*—Flynn, Thiel, Boutell & Tanis, P.C.

[57] ABSTRACT

Platform units for scaffolding must be light and strong in design and be usable without risk of accident. Therefore, all their parts are designed for a long service life, and should also be included in the static analysis. High rigidity of the corner joints of the rectangular support frame for the platform unit is thereby advantageous as well as having the narrowest possible gaps between adjacent platform units. The invention uses for this purpose, a three-dimensional arrangement of the mounting brackets on the support frames, which combine relative structural symmetry with the fact that the mounting brackets are offset, and thus permit a narrow gap formation between the platform units. The corner joints of the support frames are, in spite of their light construction, resistant to distortion and any uncertainty due to the use of wooden planks for the floor surface is avoided by using a friendly holding frame.

12 Claims, 5 Drawing Sheets

W

V
23c 2
23b
23
23a
3
3
2

HQ
11b

AC
22'
12c
12b

PLATFORM UNIT

FIELD OF THE INVENTION

The invention relates to a platform unit for a scaffolding or the like, which can be suspended on two horizontal transverse spars of the scaffolding, consisting of at least one rectangular support frame composed of longitudinal bars and crossbars (the end sides of the support frame are formed by the crossbars and are each adjacent to the crossbars of a further support frame), a plate-shaped floor surface provided on the support frame and serving as a walk-on surface, and at least two hook-shaped mounting brackets fastened to the crossbars on each end side of the support frame, and covering the transverse spars of the scaffolding.

A platform unit of this type is already known, for example, from the Patent EP 0 451 616 B1. The transverse spar is formed into an upwardly open U-profile, between the two vertical webs of which the mounting brackets of the support frame adjoining the respective web can be suspended. Such an arrangement has the disadvantage that relatively wide gaps remain between adjacent support frames, which gaps represent a considerable danger in case of accidents (tripping) during the use of the platform unit. The transverse spar itself is not covered, and open spaces remain between the transverse spar and the support frames due to the construction of the mounting brackets. The horizontal segment of the U-profile being used as the transverse spar can thereby not be shortened at random because the hooks of the mounting brackets must be sufficiently strong and require a corresponding space between the webs.

The mounting brackets in the known design are positioned inside of the longitudinal bars, which are constructed as extruded hollow sections with an approximately rectangular cross section, and are there riveted to a vertical web of this hollow section. A mounting bracket centrally provided on the respective crossbar is—differently designed—instead welded to the crossbar. The structurally complicated design is necessary because the crossbars are welded to the inner webs of the longitudinal bars and therefore the longitudinal bars remain open at their end sides.

The respective support frame of such platform units is equipped with a plate-shaped floor surface, which in general—just like in the described known design—consists of a glued plywood and is riveted to the support frame. The high bearing forces during the use of the platform unit results over time in an enlargement of the rivet bores in the plywood so that the floor surface is not able to contribute to the stiffness of the platform unit and is not taken into consideration when its static rigidity is analyzed. The, even if only slight, increasing mobility of the floor surface on the support frame contributes moreover to the reduction in the safety of the flooring during use of the platform unit.

Therefore, the basic purpose of the invention is to provide a platform unit of the type identified in detail above with safer simple means and in operation, and moreover to construct such a unit in such a manner that the floor surface over time improves the stiffness of the platform unit and can be included in the static rigidity analysis.

The purpose is attained according to the invention in such a manner that the mounting brackets, which are associated with one another, are arranged on the oppositely lying end sides each laterally offset with respect to the longitudinal bars in a plane parallel thereto. Such an arrangement conveniently makes it possible that the mounting brackets of adjacent support frames cannot abut, and the gap between the support frames and, in particular, their plate-shaped floor surfaces is determined only by the longitudinal direction expansion of a mounting bracket, and can in this manner be kept so small that it is practically no longer noticed during the use of the platform unit.

It is particularly practical when the mounting brackets are provided in pairs on the crossbars and near the longitudinal bars, whereby they can be arranged on the crossbars of the same support frame in such a manner that the pairs of mounting brackets provided diagonally on the support frame have respectively the same distance from the respectively adjacent longitudinal side. In spite of the actual nonsymmetrical design of the arrangement, it is assured in this manner that several platform units can be stacked one on top of the other and the mounting brackets thereby lie each exactly one above the other without which attention would have to be paid to the orientation of the platform units.

It is advantageous when the two distances between the mounting brackets of one and the same crossbar differ from the longitudinal side adjacent to the respective mounting bracket by at least the thickness of the mounting bracket—measured in the direction parallel to the end sides—, however, thereby exceeding this amount as little as possible so that the stress on the floor surfaces is as much as possible directly transferred into the longitudinal bars, in particular, for example, also because two mounting brackets diagonally provided on the support frame are provided flush with the respective longitudinal sides so that the complementary mounting brackets must not be positioned too far to the inside.

The crossbars and/or the longitudinal bars consist in a particularly preferred embodiment of the invention of a preferably extruded hollow profile approximately rectangular in cross section, each hollow section is composed of two parallel vertical webs and two horizontal segments. Such a box-shaped design of the longitudinal bars and/or the crossbars results in a distortion-free construction of the support frame, in particular when its corner joint is cut out of the inner web of the longitudinal bar with the width of the cut conforming to the crossbar and at least the webs of the crossbar are guided through to the outer web of the longitudinal bar and are welded to the segments and/or webs of the longitudinal bar. Such a corner joint is in this manner very strongly constructed and can be highly stressed. Furthermore, such a construction has the advantage that the end sides of the support frame, similar to its longitudinal sides, each form closed surfaces. In detail, one can thereby proceed such that the height of the crossbars falls below the height of the longitudinal bars in the amount of the thickness of their segments. It is also possible in this case that the entire crossbar is guided through to the outer web of the longitudinal bar, thusly including its segments which are then available for screwing or riveting to the longitudinal bar and the floor surface.

Guide ribs can be constructed for the lateral locking of the floor surface and as a stacking aid on the belts of the longitudinal bars along the side the support frame such that their height falls below the height of the floor surface resting on the segments, whereby the height of the guide ribs above the associated segment is preferably approximately half the height of the floor surface so that one of the guide ribs is used to lock the floor surface and the other one as a stacking aid which engages the corresponding edge gap of a further support frame along the floor surface provided thereabove or therebelow.

It is particularly advantageous when the mounting brackets are welded to the crossbars of the support frame, the end sides of which being available for this along their entire width. The mounting brackets being positioned back into the longitudinal bars is no longer necessary so that the mounting of the mounting brackets is extremely simple.

A lasting inherent stability of the support frame is provided when the floor surface is composed of wooden planks, in particular plywood sheets, which are held by a metallic holding frame which rests on the segments of the support frame, and which extends around the entire floor surface, preferably, however, engages only the sides of the floor surface, which sides rest on the longitudinal bars, in particular when the floor surface is connected, preferably riveted, at its holding frame by means of connecting elements to the support frame. The holding frame prevents the wooden planks from permanent deformation in the bores for the connecting elements so that wear-related slack in the area of these connecting elements can be avoided even in the case of high stress on the platform unit.

In order to enable a passage through the platform unit, it is advantageous when at least a portion of the floor surface is constructed as a plate and is pivotal about an axle, which is parallel to a longitudinal bar and is stationary positioned on the same. The plate can be particularly highly stressed when it rests with a portion of its edging on a crossbar. It is advantageous when the axle is formed by hinge pieces, which are fastened on the longitudinal bar. Of course, the plate demands, in a conventional manner, a support strip if a portion of its edging would not be otherwise supported.

As a whole a platform unit of the invention has a highly improved operating safety and a long life, however, it can be very easily constructed because the floor surface being included in the static performance analysis.

The invention will be discussed in greater detail hereinafter in connection with one exemplary embodiment and the drawings, in which.

Figure 4:
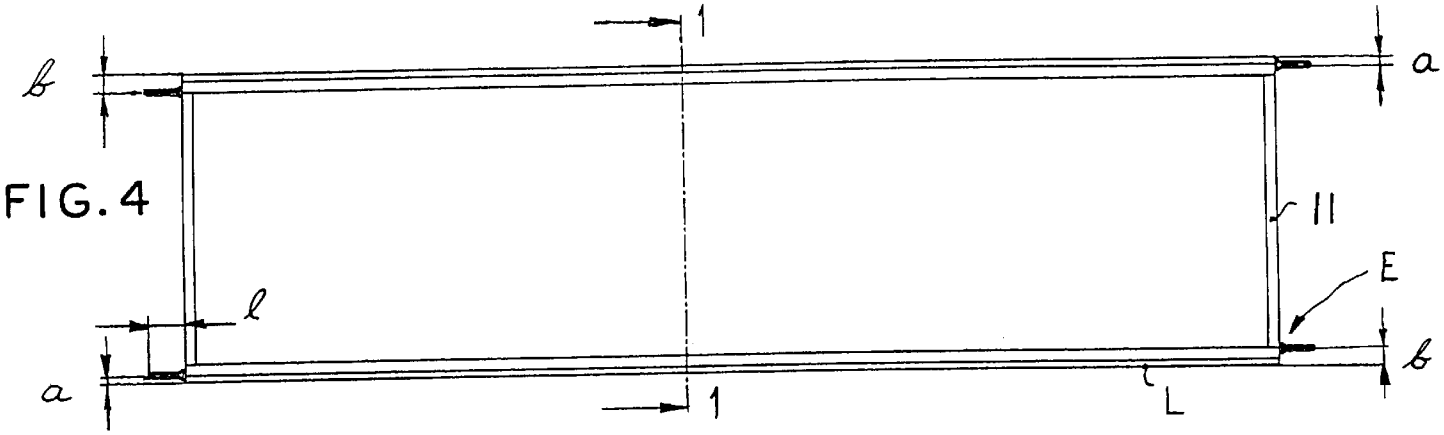
Figure 3:
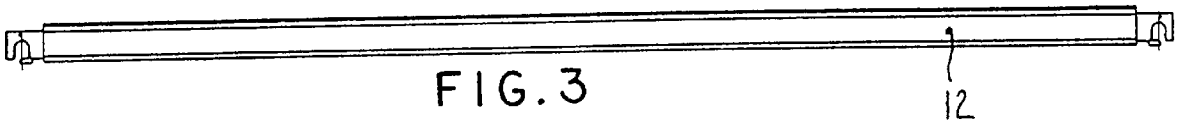
Figure 1:
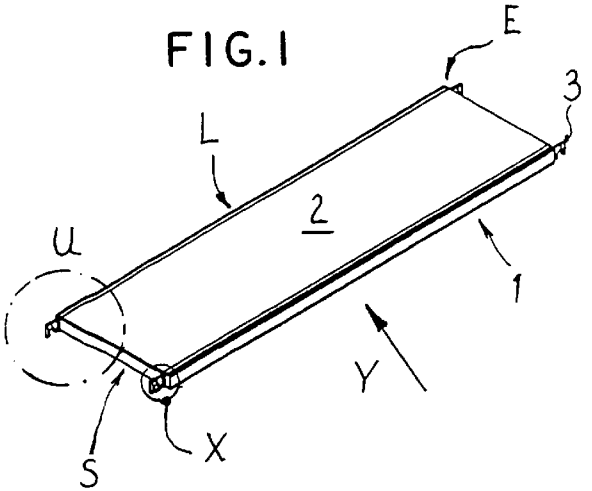
FIG. 1 is a three-dimensional view of a platform unit of the invention.
Figure 5:
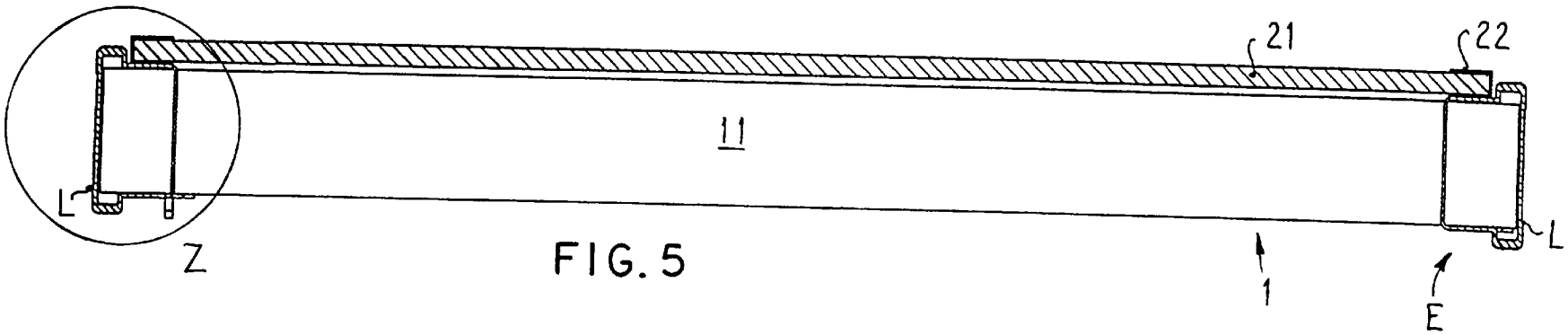
Figure 6:
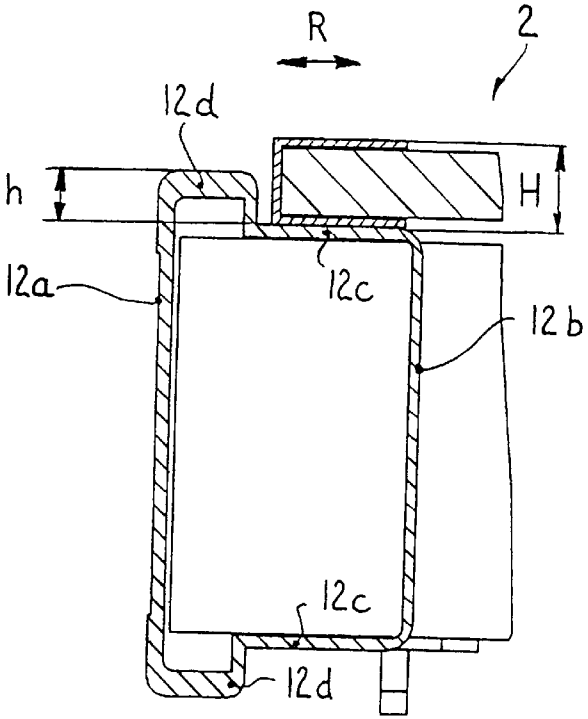
Figure 7:
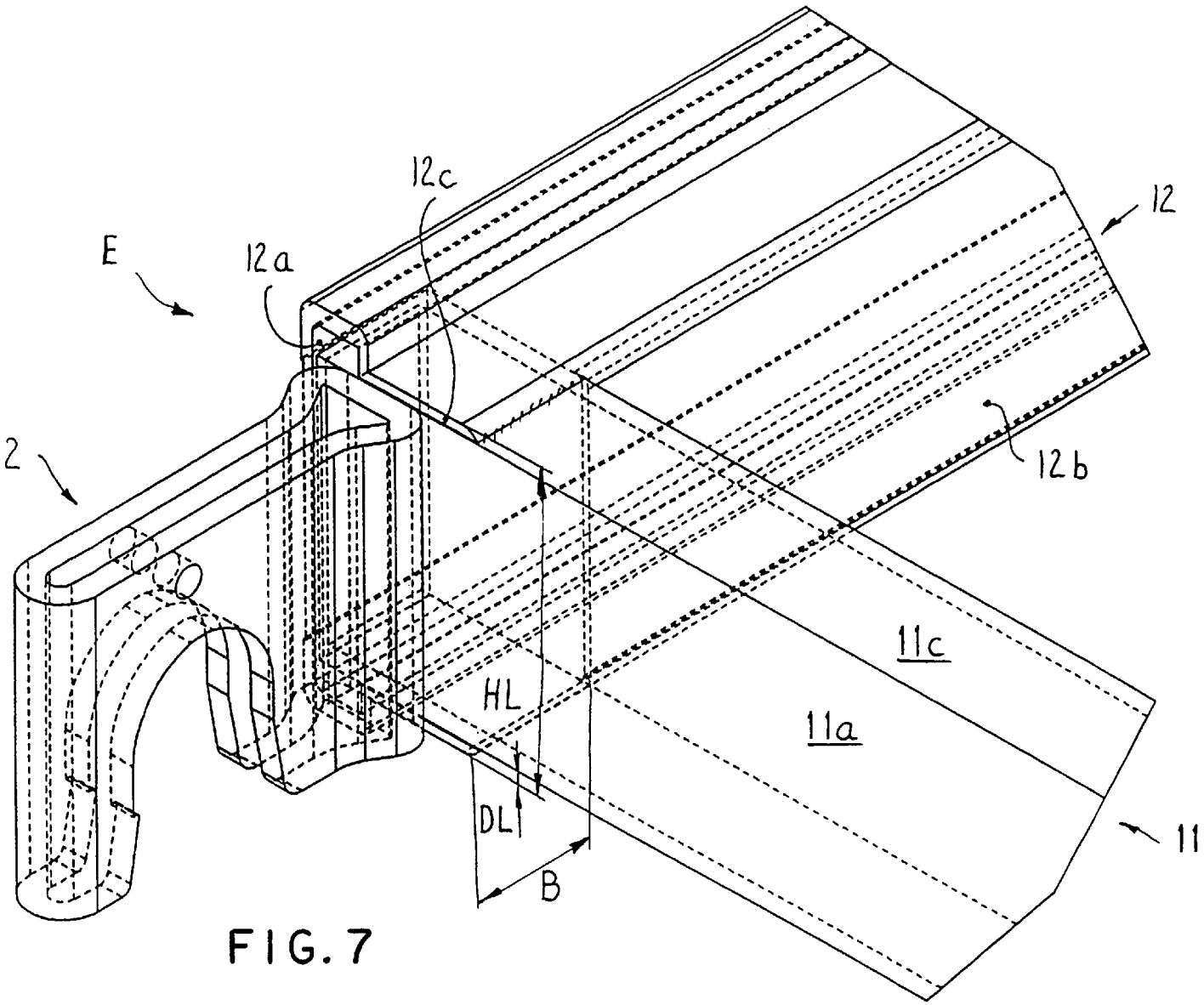
Figures 8, 9, 10, 11, 12:
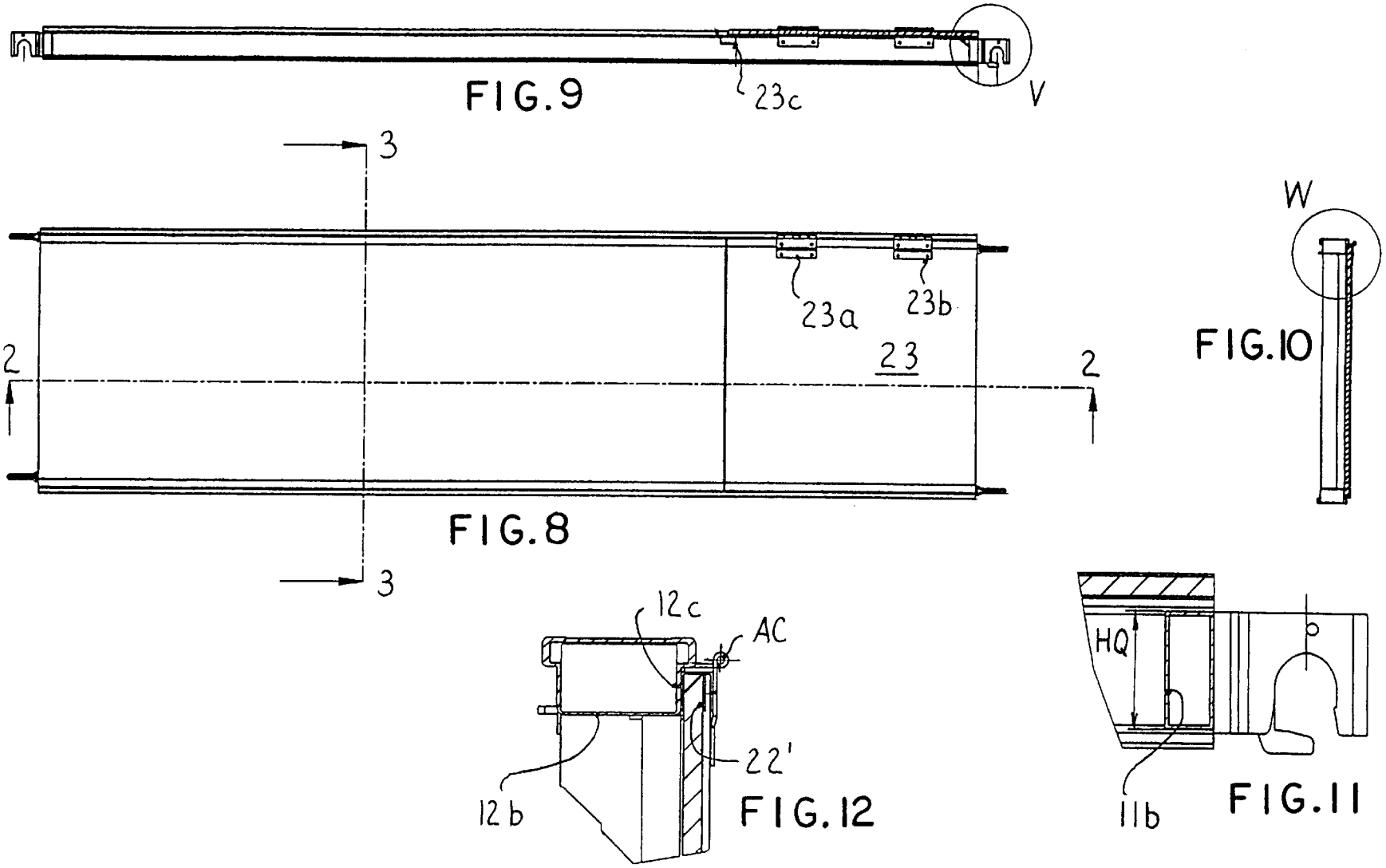
Figure 13:
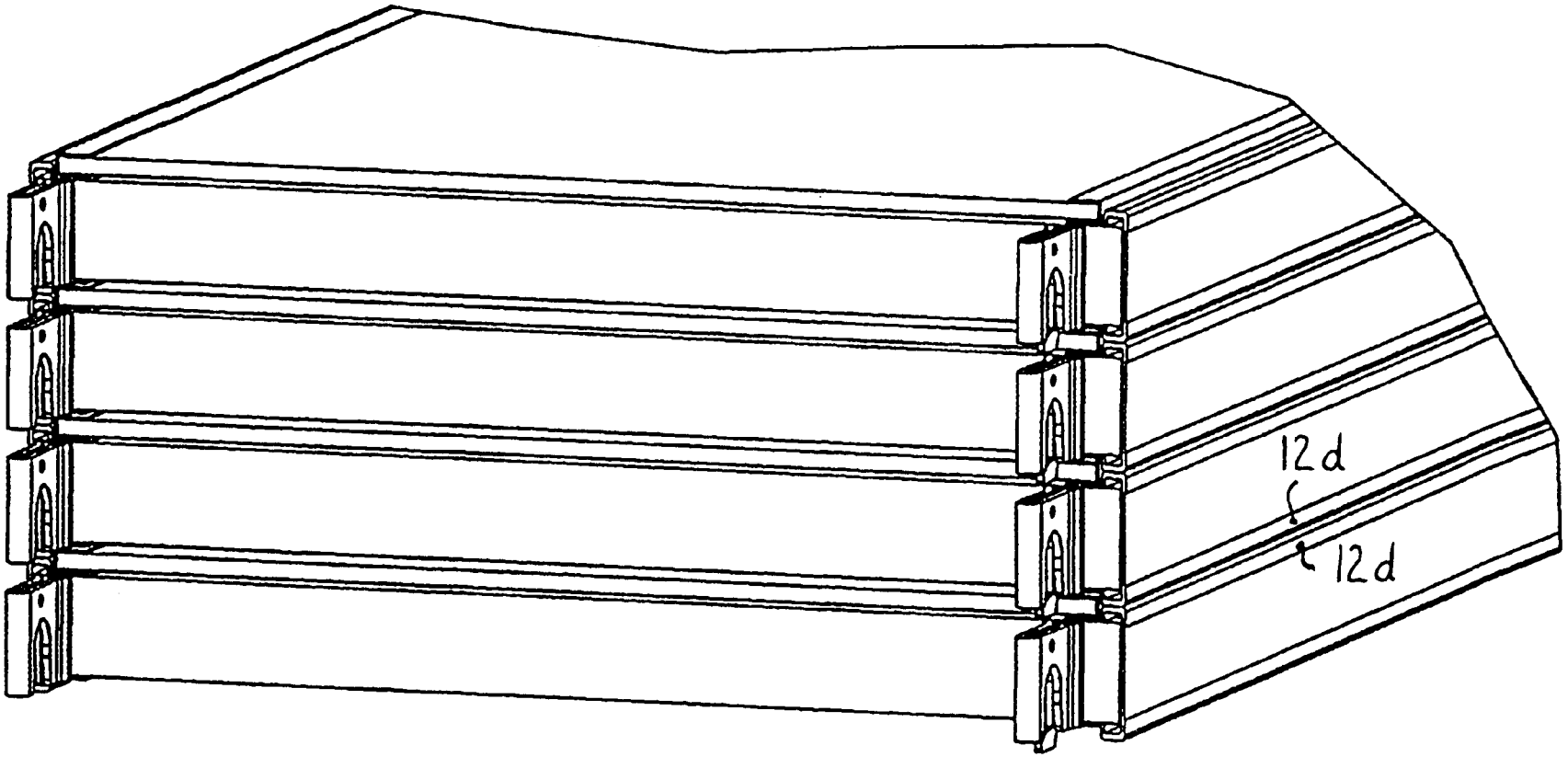

FIG. 3 shows a side view viewed along Y of FIG. 1 approximately twice in size, FIG. 4 is a bottom view of FIG. 3, FIG. 5 is a much enlarged cross-sectional view taken along line A—A of FIG. 4, shown turned at 90° in its position of use, FIG. 6 shows an enlarged detail of Z in FIG. 5, FIG. 7 shows a much enlarged detail of U in FIG. 1, from which the construction of a corner joint can be recognized, FIG. 8 is a top view of a platform unit of the invention, which is equipped with an opening, FIG. 9 is a cross-sectional view taken along line B—B of FIG. 8, FIG. 10 is a cross-sectional view taken along line C—C of FIG. 8, FIG. 11 shows an enlarged detail of V in FIG. 9, FIG. 12 shows an enlarged detail of W in FIG. 10, and FIG. 13 shows a stack of several platform units of the invention, all in a partial illustration.

Figure 2:
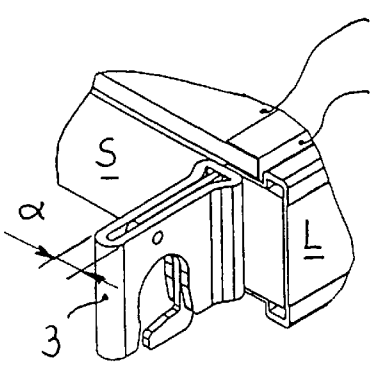
FIG. 2 shows a much enlarged detail of X in FIG. 1.

FIG. 1 illustrates an overview of an inventive rectangular platform unit, which already shows its assembly of a support frame 1 and a plate-shaped floor surface 2. Also four mounting brackets 3 are shown, which are mounted near the four corner joints E of the support frame 1 on its end sides S. FIG. 2 shows that the mounting brackets 3 are constructed hook-shaped and are directly fastened to the end sides S, which extend to the two longitudinal sides L. The end and longitudinal sides S, L of the support frame 1 are formed by crossbars 11 and longitudinal bars 12, as they are shown in FIGS. 3 and 4.

FIG. 4 shows that the mounting brackets 3 are provided at distances a, b from the longitudinal sides, which are the same at diagonally oppositely lying corner joints E, however, are different on one and the same crossbar 11. The mounting brackets 3 fastened at the distance a from the longitudinal side L are approximately flush with this longitudinal side L, whereas the other ones, which are spaced at a greater distance b, are removed so far from the longitudinal side L that the mounting brackets 3, when the platform units are aligned in a row, can be suspended from both sides on the same transverse spar of a scaffolding and will rest end to end so that the remaining gap between the adjacent platform units is not significantly larger than the length "1" of the mounting brackets 3 (FIG. 4). The difference between the distances a, b is slightly greater than the thickness d of the mounting brackets 3 (FIG. 2) in order to safely avoid a jamming of two mounting brackets 3 adjacent to one another on the same transverse spar.

FIGS. 5 and 6 show that the longitudinal bars 12 consist of a hollow profile, which is essentially rectangular in cross section and can be manufactured via an extrusion process, and which is composed of two parallel vertical webs 12*a* and 12*b* and two horizontal, however, not continuous, also parallel segments 12*c* so that the longitudinal bars 12 are constructed beamlike. Guide ribs 12*d*, which are flush with the longitudinal sides L and extend over the entire length of longitudinal sides, are provided on the segments 12*c*, or rather in place of a portion of the segment 12*c*, for primarily stabilizing the position of the floor surface 2 in a direction R parallel to the crossbars 11. The surface, which remains free of the guide ribs 12*b* on the segments 12*c*, is used as a support for the floor surface 2. The height h of the guide ribs 12, which themselves are constructed rectangularly in cross section, reaches thereby up to half of the height H of the floor surface 2 so that the guide ribs 12*d* can in this manner also be used as a stacking aid. FIG. 13 shows that they rest on one another thereby enclosing the floor surfaces 2, thereby safely preventing a shifting of the platform units resting one on top of the other in the direction R (FIG. 6) when stacked.

FIGS. 5 and 6 show furthermore that the crossbars 11 engage the longitudinal bars 12 in the corner joints E. The details of this are shown in FIG. 7. FIG. 7 clearly shows that the inner web 12*b* of the longitudinal bar 12 is removed at its end to a width B and the end of the crossbar 11 is guided into the longitudinal bar 12 so that it hits the outer web 12*a* of the longitudinal bar. The crossbar 11 also has a hollow profile manufactured via an extrusion process and is rectangular in cross section, as can be seen in FIG. 11. Its height HQ is reduced when compared with the height HL of the longitudinal bar 12 measured through approximately twice the thickness DL of a segment 12*c* of the longitudinal bar 12 so that it rests with clearance within its segments 11*c* on the segments 12*c*. It is therefore possible without difficulty to weld the segments 11*c* and 12*c* together in the intersecting area, along with an inner web 11*b* of the crossbar 11 to the inner web 12*b* of the longitudinal bar 12. Also the joining of the two outer webs 11*a* and 12*a* can be easily constructed in such a manner that a welding seam can be provided therebetween. The corner joints E can in this manner be constructed extraordinarily inherently stable, even though in each case a full end surface S is guaranteed. The hook-shaped mounting brackets 2 are fastened on said end surfaces S such as by welding.

FIGS. 2, 6 and 7 easily show also the detailed construction of the plate-shaped floor surface 2. It consists accordingly mainly of wooden planks 21 as floor elements, best in the form of glued together plywood sheets. The wooden planks 21 are edged along the longitudinal bars 12 by a holding frame 22, here in the form of a simple U-profile, into which the wooden planks 21 are moved and which are fixedly connected, for example riveted, to the support frame by means of connecting elements, not shown in the drawings, forming a secondary positional stabilizer, now also in longitudinal direction of the platform unit.

The platform unit of the invention is further broadened in FIGS. 8 to 10 and 11 in its function showing a design with a plate 23, otherwise it corresponds with the platform unit discussed in detail above so that it is sufficient to disclose the necessary changes. The plate 23 (FIG. 12) is pivotal about an axle AC, which is formed by two hinge pieces 23*a*. The axle AC is positioned parallel to the longitudinal bar 12. The holding frame 22 is in the area of the plate 23 replaced with an, if necessary slightly differently profiled, holding frame 22', on which the hinge pieces 23*a*—best on both sides of the legs of the holding frame 22'—can be fastened. On the other hand, it is advantageous to fasten the hinge pieces 23*a* both on the upper segment 12*c* of the longitudinal bar 12 and also on its inner web 12*b*, for example, by means of rivets or other suitable connecting elements 23*b*. The plate 23 is arranged such that it can be placed on the one side on the upper segment 11*c* of a crossbar 11 and on the other side on a support strip 23*c*, which is clamped between the longitudinal bars 12.

We claim:

1. A platform unit for a scaffolding, comprising at least one rectangular support frame defining longitudinal sides and ends, the support frame comprising a plurality of longitudinal bars and a plurality of crossbars joined at corner joints, the crossbars be oriented at the ends of the support frame, the longitudinal bars be oriented at the longitudinal sides of the support frame, a floor surface being provided on the support frame and serving as a user supporting surface, and at least two hook-shaped mounting brackets being fastened to the respective crossbar at each end of the support frame, the mounting brackets being adapted to be received on respective transverse spars of the scaffolding, the mounting brackets extending from the crossbars in a direction parallel to the longitudinal sides and being inwardly spaced from the longitudinal sides of the support frame, the mounting brackets arranged at one of the ends being laterally offset with respect to the longitudinal bars, at least one of the crossbars and the longitudinal bars having an extruded hollow profile which is generally rectangular in cross section, and each of the crossbars and longitudinal bars having an inner web facing inwardly of the support frame, an outer web facing outwardly of the support frame, an upper horizontal segment joining upper portions of the inner and outer webs, and a lower horizontal segment joining lower portions of the inner and outer webs, the inner and outer web being oriented vertically and parallel to each other, the inner web of each of the longitudinal bars being cut out at the corner joints of the support frame by a width of the adjacent, there-connected crossbar, the height of the crossbars being less than the height of the longitudinal bars by an amount equal to a thickness of the upper and lower segments of the longitudinal bars, the entire profile of the crossbar extending laterally through the hollow interior of the longitudinal bar to the outer web of the longitudinal bar, and guide ribs being positioned on the upper and lower horizontal segments of the longitudinal bars extending along the side of the support frame, the guide ribs having a height less than the height of the floor surface provided on the support frame, the guide ribs on the upper horizontal segment and the longitudinal side of the floor surface defining a region for receiving the guide ribs on the lower horizontal segment from another frame when at least two frames are stacked on top of each other.

2. The platform unit according to claim 1, wherein the height of the guide ribs above an associated one of the upper and lower segments is approximately half of the height of the floor surface.

3. The platform unit according to claim 1, wherein the floor surface is comprised of wooden planks, held by a metallic holding frame which rests on the upper segments of the longitudinal bars and which extends the length of the longitudinal bars.

4. The platform unit according to claim 3, wherein means for connecting the holding frame to the support frame is provided so that the floor surface is fixed to the support frame.

5. The platform unit according to claim 1, wherein at least a portion of the floor surface is constructed as a plate and is pivotal about an axle parallel to one of the longitudinal bars, the axle being stationary on the one longitudinal bar.

6. The platform unit according to claim 5, wherein an edge of the plate rests with a portion thereof on a crossbar.

7. The platform unit according to claim 5, wherein the axle is formed by hinge pieces, which are fastened on the one longitudinal bar.

8. The platform unit according to claim 1, wherein the mounting brackets are provided in pairs on the crossbars and near the longitudinal bars.

9. The platform unit according to claim 8, wherein the mounting brackets are welded to the crossbars of the support frame.

10. The platform unit according to claim 8, wherein the pairs of mounting brackets are arranged on the crossbars of the same support frame in such a manner that the mounting brackets provided diagonally from each other on the support frame are spaced each at the same distance from the respectively adjacent longitudinal side.

11. The platform unit according to claim 10, wherein the two distances from each of the mounting brackets positioned on one of the crossbars to the respective adjacent longitudinal side differ at least in the amount of a width of the mounting bracket, the width being measured in a direction parallel to the ends.

12. The platform unit according to claim 10, wherein two of the mounting brackets provided diagonally from each other on the support frame are provided flush with the respective longitudinal side.

* * * * *

UNITED STATES PATENT AND TRADEMARK OFFICE

CERTIFICATE OF CORRECTION

PATENT NO. : 5,967,262
DATED : October 19, 1999
INVENTOR(S) : Guenther KRAUSE

It is certified that error appears in the above-identified patent and that said Letters Patent is hereby corrected as shown below:

On the title page, item [73] Assignee, and in Column 1, change "Krausse-Werk GmbH & Co. KG" to ---Krause-Werk GmbH & Co. KG---.

Signed and Sealed this

Seventh Day of November, 2000

*Attest:*

Q. TODD DICKINSON

*Attesting Officer*

*Director of Patents and Trademarks*